US009740143B2

(12) United States Patent
Kato

(10) Patent No.: US 9,740,143 B2
(45) Date of Patent: Aug. 22, 2017

(54) IMAGE FORMING APPARATUS

(71) Applicant: Yuichiro Kato, Kanagawa (JP)

(72) Inventor: Yuichiro Kato, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 15/078,121

(22) Filed: Mar. 23, 2016

(65) Prior Publication Data

US 2016/0291509 A1 Oct. 6, 2016

(30) Foreign Application Priority Data

Mar. 31, 2015 (JP) ..... 2015-071743
Jan. 29, 2016 (JP) ..... 2016-015547

(51) Int. Cl.
*G03G 15/16* (2006.01)
*G03G 21/20* (2006.01)

(52) U.S. Cl.
CPC ..... *G03G 15/1605* (2013.01); *G03G 21/203* (2013.01); *G03G 2215/00772* (2013.01); *G03G 2215/00776* (2013.01); *G03G 2215/0129* (2013.01)

(58) Field of Classification Search
CPC ..... G03G 15/1675; G03G 2215/772; G03G 15/80; G03G 15/6591; G03G 21/20; G03G 21/203; G03G 21/03
USPC ..... 399/38, 42, 44, 45, 66, 297–302
See application file for complete search history.

(56) References Cited

U.S. PATENT DOCUMENTS 8,909,081 B2 * 12/2014 Hara ..... G03G 15/1605 399/297
2005/0281569 A1 12/2005 Nishimura
2014/0193175 A1 7/2014 Kato et al.
2014/0270873 A1 9/2014 Kato et al.
2014/0353126 A1 12/2014 Sengoku

FOREIGN PATENT DOCUMENTS

JP 07-146619 6/1995
JP 2002-351234 12/2002
JP 2006-003538 1/2006
JP 2015-007749 1/2015

* cited by examiner

*Primary Examiner* — Hoan Tran
(74) *Attorney, Agent, or Firm* — Oblon, McClelland, Maier & Neustadt, L.L.P.

(57) ABSTRACT

An image forming apparatus includes a transfer unit that transfers a toner image on an image bearer onto a transfer medium. The image forming apparatus includes a control unit that controls a transfer voltage to be output to the transfer unit in accordance with a certain condition. The control unit applies currents having at least two different values while paper is not being fed. The two current values are lower than a current value during paper feeding. The control unit estimates an output voltage on a basis of a voltage detected through the application of the currents. When the estimated output voltage falls below a certain limiter voltage, the control unit controls to bring the output voltage to a value calculated through the certain condition. When the estimated output voltage exceeds the certain limiter voltage, the control unit controls to bring the output voltage to the limiter voltage.

6 Claims, 10 Drawing Sheets

IMAGE FORMING APPARATUS

CROSS-REFERENCE TO RELATED APPLICATIONS

The present application claims priority to and incorporates by reference the entire contents of Japanese Patent Application No. 2015-071743 filed in Japan on Mar. 31, 2015 and Japanese Patent Application No. 2016-015547 filed in Japan on Jan. 29, 2016.

BACKGROUND OF THE INVENTION

1. Field of the Invention

The present invention relates to an image forming apparatus.

2. Description of the Related Art

An image forming apparatus typically forms a toner image on an image bearer on the basis of image information, transfers the toner image onto a recording medium such as paper and an OHP sheet, and causes the recording medium that bears thereon the toner image to pass through a fixing unit, so that the toner image can be fixed onto the recording medium through heat and pressure.

The transfer unit as transfer means that transfer the toner image can, however, cause an unusual image to occur. Such an unusual image can occur due to, for example, an electric discharge occurring as a result of an output of an abnormal voltage with an increased load that results from, for example, deterioration of a transfer roller over time.

In contrast, the system applies a current for estimation before paper feeding is started to detect a current-voltage characteristic, thereby controlling to achieve a current appropriate for a paper type, a use environment, and other factors (see, for example, Japanese Patent Application Laid-open No. 2002-351234).

The image forming apparatus disclosed in Japanese Patent Application Laid-open No. 2002-351234 applies constant currents having different values to a transfer roller during times in which paper is not being fed. The image forming apparatus then measures voltages when the respective currents are applied to thereby calculate a current-voltage characteristic of the transfer roller.

The different current values are set close to a minimum value and a maximum value of the current that flows through the transfer roller during paper feeding.

Thus, the image forming apparatus disclosed in Japanese Patent Application Laid-open No. 2002-351234 unfortunately entails occurrence of an electric discharge for the following reason. Specifically, when a load increases as a result, for example, of deterioration over time of the transfer roller, the application of the current close to its maximum value causes an excessively high voltage to be output also at the time of application of the current for estimation before the start of paper feeding.

Therefore, it is desirable to provide an image forming apparatus that does not develop a faulty symptom over time during application of a current.

SUMMARY OF THE INVENTION

It is an object of the present invention to at least partially solve the problems in the conventional technology.

According to an aspect of the present invention, there is provided an image forming apparatus including a transfer unit that transfers a toner image on an image bearer onto a transfer medium, the image forming apparatus including: a control unit that controls a transfer voltage to be output to the transfer unit in accordance with a certain condition, wherein the control unit: applies currents having at least two different values during times in which paper is not being fed, the two current values being lower than a current value during paper feeding; estimates an output voltage on a basis of a voltage detected through the application of the currents; controls, when the estimated output voltage falls below a certain limiter voltage, to bring the output voltage to a value calculated through the certain condition; and controls, when the estimated output voltage exceeds the certain limiter voltage, to bring the output voltage to the limiter voltage.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
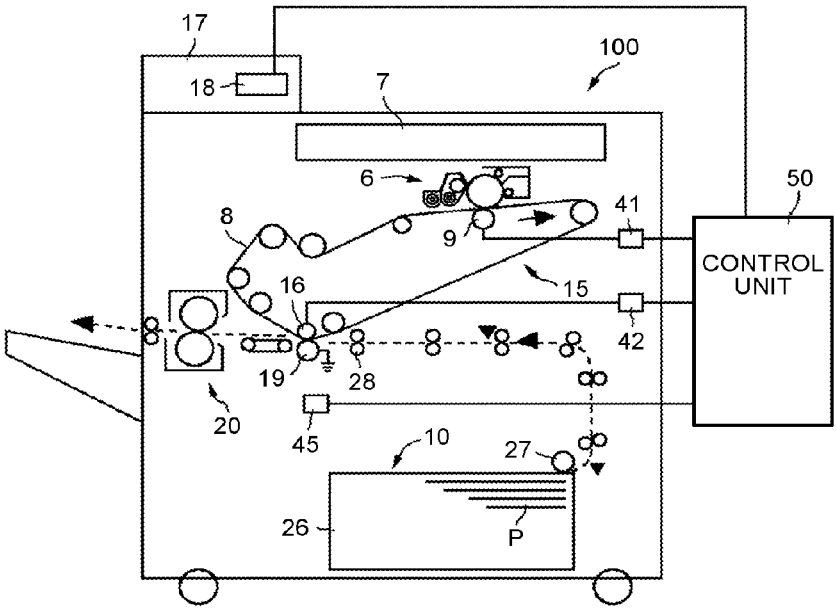
FIG. 1 is a configuration diagram schematically illustrating an image forming apparatus according to an embodiment of the present invention.

The following describes, with reference to the accompanying drawings, an embodiment for carrying out the present invention. In each of the drawings for describing the present embodiment, elements including members and components that have identical functions or shapes are identified, wherever distinguishable, by the same reference numerals and descriptions for those elements will not be duplicated.

FIG. 1 illustrates a monochrome printer as an exemplary image forming apparatus according to an embodiment of the present invention. Understandably, while the following description is directed to the monochrome printer, the present invention can be likewise applied to well-known color image forming apparatuses.

Figure 2:
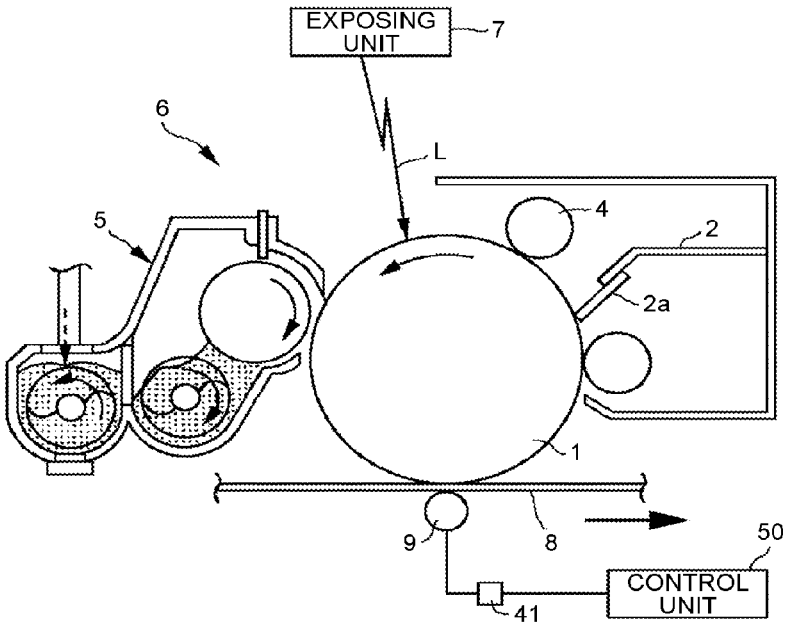
FIG. 2 is a configuration diagram schematically illustrating an image forming unit of the image forming apparatus illustrated in FIG. 1.

The following describes a general configuration and operations of the image forming apparatus with reference to FIGS. 1 and 2. FIG. 1 is a configuration diagram of the printer as the image forming apparatus. FIG. 2 is an enlarged view of an image forming unit of the printer illustrated in FIG. 1.

As illustrated in FIG. 1, this image forming apparatus 100 includes an intermediate transfer belt device 15 disposed at a center of the image forming apparatus 100. The image forming apparatus 100 includes an image forming unit 6 attachably and removably disposed so as to face an intermediate transfer belt 8. The intermediate transfer belt 8 serves as an image bearer and a transfer member. The image forming unit 6 corresponds to black. A paper feeding unit 10 is disposed at a lower portion inside the image forming apparatus 100. Additionally, a fixing device 20, as a fixing unit, is disposed at the end of a paper conveyance path along which a recording medium P, as a transfer member, is conveyed from the paper feeding unit 10.

The intermediate transfer belt device 15 includes the endless intermediate transfer belt 8 and a plurality of roller members. The intermediate transfer belt 8, while being tensioned and supported by the roller members, is moved through a rotational drive of a single roller member 1.

As illustrated in FIG. 2, the image forming unit 6 includes, for example, a photoconductor drum 1, as an image bearer, a charging unit 4 disposed around the photoconductor drum 1, a developing unit 5, a cleaning unit 2, and a charge neutralizing unit. An image forming process (charging step, exposing step, developing step, transfer step, and cleaning step) is performed on the photoconductor drum 1 and an image (toner image) is thereby formed on the photoconductor drum 1.

As illustrated in FIG. 1, the paper feeding unit 10 includes a paper feeding tray 26 and a paper feeding roller 27. Specifically, paper P as the recording medium is stacked and stored in the paper feeding tray 26. The paper feeding roller 27 separates one sheet at a time from the top of the paper P stored in the paper feeding tray 26 and feeds the sheet.

The fixing device 20 includes a fixing roller and a pressure roller.

As illustrated in FIG. 2, the photoconductor drum 1 is rotationally driven counterclockwise by a drive motor. At the position of the charging unit 4, the photoconductor drum 1 has a uniformly charged surface (charging step). It is noted that the present embodiment includes as the charging unit 4 a contact type charging roller that comes into contact with the photoconductor drum 1. Different types of charging roller may nonetheless be used, including a noncontact type charging roller facing the photoconductor drum 1 with a certain gap provided therebetween and a corona discharging charger. The surface of the photoconductor drum 1 thereafter reaches a position at which the photoconductor drum 1 is irradiated with laser light L emitted from an exposing unit 7. At this position, an electrostatic latent image is formed through exposure scanning (exposing step).

Thereafter, the surface of the photoconductor drum 1 reaches a position facing the developing unit 5 and the electrostatic latent image is developed at this position to be formed into a toner image (developing step). The surface of the photoconductor drum 1 thereafter reaches a position facing the intermediate transfer belt 8 and a primary transfer roller 9, as a transfer device. At this position, the toner image on the photoconductor drum 1 is transferred onto the intermediate transfer belt 8 (primary transfer step).

When the surface of the photoconductor drum 1 thereafter reaches a position facing the cleaning unit 2, untransferred toner left on the photoconductor drum 1 is collected by a cleaning blade 2*a* into the cleaning unit 2 (cleaning step). The surface of the photoconductor drum 1 then reaches a position facing the charge neutralizing unit and residual potential on the photoconductor drum 1 is removed at that position.

The primary transfer roller 9 operates with the photoconductor drum 1 to clamp the intermediate transfer belt 8 therebetween, thus forming a primary transfer nip. A control unit 50, as a control device, to be described later controls a primary transfer power source 41, so that a certain transfer voltage having polarity opposite to that of the toner is applied to the primary transfer roller 9. The intermediate transfer belt 8 travels in the direction of the arrow in FIGS. 1 and 2 and the toner image on the photoconductor drum 1 is primarily transferred onto the intermediate transfer belt 8 at the position of the primary transfer nip of the primary transfer roller 9.

As illustrated in FIG. 1, the intermediate transfer belt 8 onto which the toner image has been primarily transferred reaches a position facing a secondary transfer roller 19 as a transfer device. The secondary transfer roller 19 serves as a transfer device. At this position, a secondary transfer opposite roller 16 operates with the secondary transfer roller 19 to clamp the intermediate transfer belt 8 therebetween, thus forming a secondary transfer nip. The control unit 50 controls a secondary transfer power source 42, so that a transfer voltage having polarity identical to normal charging polarity is applied to the secondary transfer opposite roller 16. It is noted that a transfer voltage having polarity opposite to the normal charging polarity of toner may be applied to the secondary transfer roller 19. The secondary transfer roller 19 is electrically grounded.

The paper feeding unit 10 stores a plurality of sheets of the recording medium P such as transfer paper, one on top of another. Rotationally driving the paper feeding roller 27 counterclockwise in FIG. 1 causes the top sheet of the recording medium P to be fed toward a roller nip between a registration roller pair (synchronizing roller pair) 28.

The recording medium P conveyed onto the registration roller pair 28 is temporarily stopped at the position of the roller nip between a stationary registration roller pair 28. The registration roller pair 28 is rotationally driven in time with the image on the intermediate transfer belt 8 to thereby convey the recording medium P toward the secondary transfer nip. A desired image is thereby transferred onto the recording medium P.

Untransferred toner that has not been transferred at the secondary transfer nip and that is left on the intermediate transfer belt 8 reaches the position of an intermediate transfer cleaning unit as the intermediate transfer belt 8 travels and is removed from the intermediate transfer belt 8.

The recording medium P onto which the image has been transferred at the position of the secondary transfer nip is conveyed onto the fixing device 20. At the position of the fixing device 20, the image transferred onto the surface of the recording medium P is fixed in the recording medium P by heat and pressure of the fixing roller and the pressure roller. The recording medium P onto which the image has been transferred is ejected out of the apparatus by a paper ejection roller pair. The recording medium P that has been ejected out of the apparatus by the paper ejection roller pair is stacked as an output image in sequence on a stack unit.

The following describes a functional configuration of the control unit 50.

Figure 6:
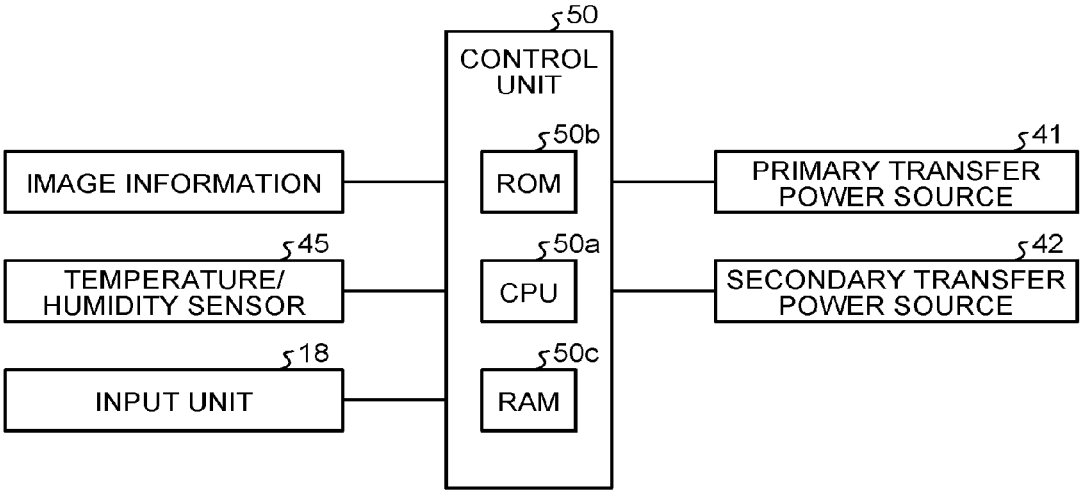
FIG. 6 is a block diagram illustrating a functional configuration of a control unit of the image forming apparatus illustrated in FIG. 1.

Reference is made to FIG. 6. The control unit 50 includes a CPU 50*a*, a ROM 50*b*, and a RAM 50*c*. The CPU 50*a* is a calculation device. The ROM 50*b* is a storage device. The RAM 50*c* is a nonvolatile memory. As illustrated in FIG. 1, the image forming apparatus 100 includes an operation panel 17 disposed at an upper portion of the image forming apparatus 100. The operation panel 17 includes an input unit 18 at which a paper type and paper weight of the paper (transfer medium) to be used, for example, are input. The control unit 50 is connected to the input unit 18 and thus acquires information on the paper type and the paper weight input by, for example, a user. Additionally, the image forming apparatus 100 includes a temperature/humidity sensor 45 that detects temperature and humidity. The control unit 50 is connected to the temperature/humidity sensor 45 and thus acquires information on the temperature and the humidity detected by the temperature/humidity sensor 45. The control unit 50 calculates a transfer current value I (T2) to be applied to the secondary transfer opposite roller 16 on the basis of, for example, image information, a detection result of the temperature and the humidity detected by the temperature/humidity sensor 45, and an acquisition result of the information on the paper type and the paper weight from the input unit 18. It is noted that, instead of the configuration of acquiring the information on the paper type and the paper weight from the input unit 18, the image forming apparatus may include a sensor that is disposed thereinside and that detects the paper type and the paper weight, so that the image forming apparatus can acquire the information on the paper type and the paper weight from the sensor. The same control may also be applicable to the transfer current value to be applied to the primary transfer roller 9. In addition, the control unit 50 controls generally the apparatus and controls drive of different devices using a control program stored in the RAM 50*c* or the ROM 50*b*.

The transfer current value I (T2) is calculated as follows.

[Transfer current value(standard control value)](μA) =standard value(μA)×linear velocity correction coefficient(%)×environment correction coefficient(%)×paper size correction coefficient(%)

Standard value: 100 μA

Linear velocity correction coefficient: The correction coefficient is determined on the basis of a set linear velocity (=surface traveling speed of the photoconductor drum 1 and the intermediate transfer belt 8). E.g.: Type-a: 432 mm/s 68%; Type-b: 500 mm/s 78%; Type-c: 640 mm/s 100%.

Environment correction coefficient: The correction coefficient is determined on the basis of the temperature and humidity detection result obtained from the temperature/humidity sensor 45 disposed inside the apparatus. E.g.: 100% under standard environment (MM environment, 23° C. 50% RH); 80% under low-temperature and low-humidity environment (LL environment, 10° C. 15% RH). The environmental category may be classified into three or more types.

Paper size correction coefficient: The correction coefficient is determined on the basis of width of the paper to be used. E.g.: 95% output for A4Y (A4 size paper fed crosswise; width 297 mm); 82% output for A4T (A4 size paper fed lengthwise; width 210 mm). The paper size category may be classified into three or more types.

Specifically, the control unit 50 calculates the transfer current value I (T2) in accordance with certain conditions, such as the linear velocity, temperature and humidity environment, paper size, paper type, paper weight, and resistance of a secondary transfer unit. It is noted that the certain conditions include at least one of the linear velocity, temperature and humidity, size of the transfer medium, type of the transfer medium, thickness of the transfer medium, resistance of the transfer unit that transfers the toner image from the image bearer to the transfer medium, and the position on the transfer medium in a transfer medium conveyance direction.

The following describes estimation of an output voltage during paper feeding.

Figure 3:
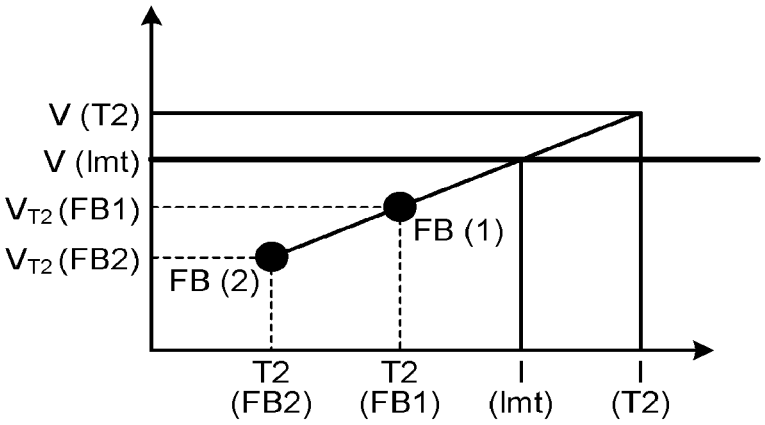
FIG. 3 is a diagram for illustrating estimation of an output voltage during paper feeding of the image forming apparatus illustrated in FIG. 1.

Reference is made to FIG. 3. The control unit 50 calculates the transfer current value I (T2) and applies, during times in which paper is not being fed, a current T2 (FB1) that corresponds to a voltage lower than an output voltage V (T2) during paper feeding, and a current T2 (FB2) that corresponds to a voltage lower than the voltage corresponding to the current T2 (FB1). The control unit 50 calculates voltages detected through the application of the foregoing currents. Specifically, the control unit 50 calculates a voltage $V_{T2}$ (FB1) that corresponds to the current T2 (FB1) and a voltage $V_{T2}$ (FB2) that corresponds to the current T2 (FB2). The control unit 50 calculates a current-voltage characteristic of the secondary transfer unit using the detected voltages. Specifically, the control unit 50 calculates slope and intercept from a current-voltage relation at the two points and estimates the current I (T2) during paper feeding and the output voltage V (T2) during paper feeding. The secondary transfer unit refers to a portion that constitutes a current path formed between a position at which the secondary transfer power source 42 outputs a secondary transfer voltage (cored bar of the secondary transfer opposite roller 16) and a position at which a ground connection is made (cored bar of the secondary transfer roller 19). Specifically, the secondary transfer unit is a portion that includes the secondary transfer opposite roller 16, the intermediate transfer belt 8, and the secondary transfer roller 19 as illustrated in FIG. 1.

The current T2 (FB1) and the current T2 (FB2) are applied during times in which paper is not being fed. To clean, for example, toner that sticks to the secondary transfer roller 19, a bias having polarity (positive polarity) opposite to polarity during the transfer may be applied before the application of the current T2 (FB1). To allow the bias of the current T2 (FB1) to rise quickly, the bias may be zeroed (may not be applied) before the application of the current T2 (FB1). Additionally, the number of times the current to be applied during times in which paper is not being fed is not limited to twice. Alternatively, the current to be applied during times in which paper is not being fed may be applied three times or more.

The following supplementarily describes the application of the current T2 (FB1) and the current T2 (FB2) that is smaller than the current T2 (FB1).

E.g.: A current of −40 μA is applied as the current T2 (FB1) and a current of −20 μA is applied as the current T2 (FB2) when a standard value of the transfer current value is −100 μA. Preferably, the current T2 (FB1) and the current T2 (FB2) are set to 10% to 50% of the transfer current value.

The image forming apparatus 100 in the present embodiment uses fixed values for the current T2 (FB1) and the current T2 (FB2) regardless of, for example, an apparatus use condition (cumulative period of time of use).

In addition, an upper limit voltage set during paper feeding, specifically, a limiter voltage V (lmt), serving as an output voltage upper limit, is set in advance to thereby avoid occurrence of, for example, an electric discharge, an abnormal image, or leak, as a result of an excessively high output voltage.

Figure 4:
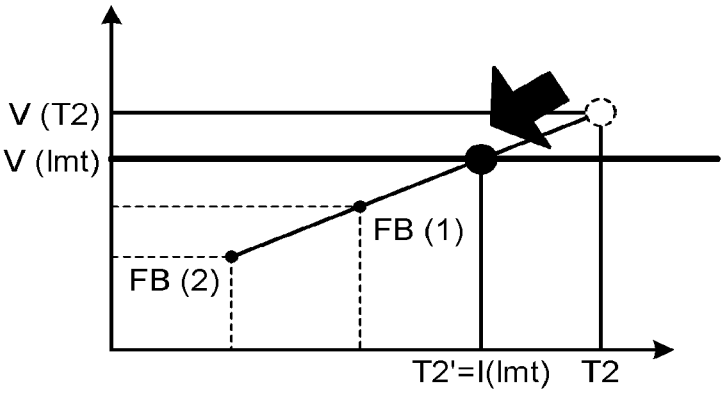
FIG. 4 is a diagram for illustrating estimation of the output voltage during paper feeding of the image forming apparatus illustrated in FIG. 1.

Specifically, the control unit 50 determines whether the output voltage estimated during times in which paper is not being fed exceeds the limiter voltage V (lmt). If the output voltage V (T2) is determined to be higher than the limiter voltage V (lmt), the control unit 50 applies a limiter current value T2' (I (lmt)) as illustrated in FIG. 4 so that the output voltage V (T2) is the limiter voltage V (lmt). It is noted that the limiter current is an upper limit of current to be supplied and the limiter voltage is an upper limit of voltage to be supplied.

Figure 5:
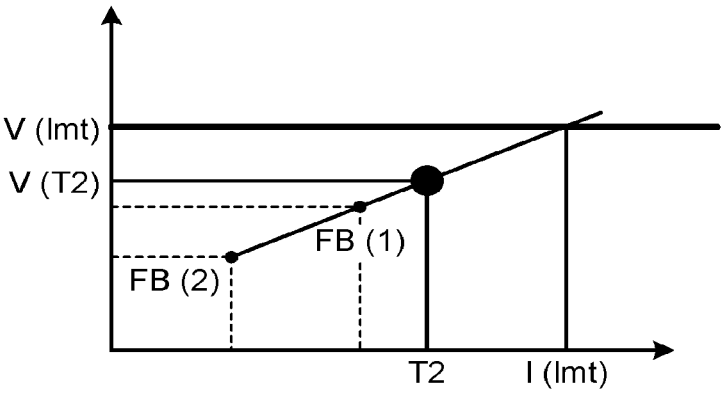
FIG. 5 is a diagram for illustrating estimation of the output voltage during paper feeding of the image forming apparatus illustrated in FIG. 1.

If the output voltage V (T2) is determined to be lower than the limiter voltage V (lmt), the control unit 50 applies a current value T2 as illustrated in FIG. 5 so that the output voltage V (T2) is a value calculated from the certain conditions including the paper type, paper weight, and the apparatus environment.

Figure 7:
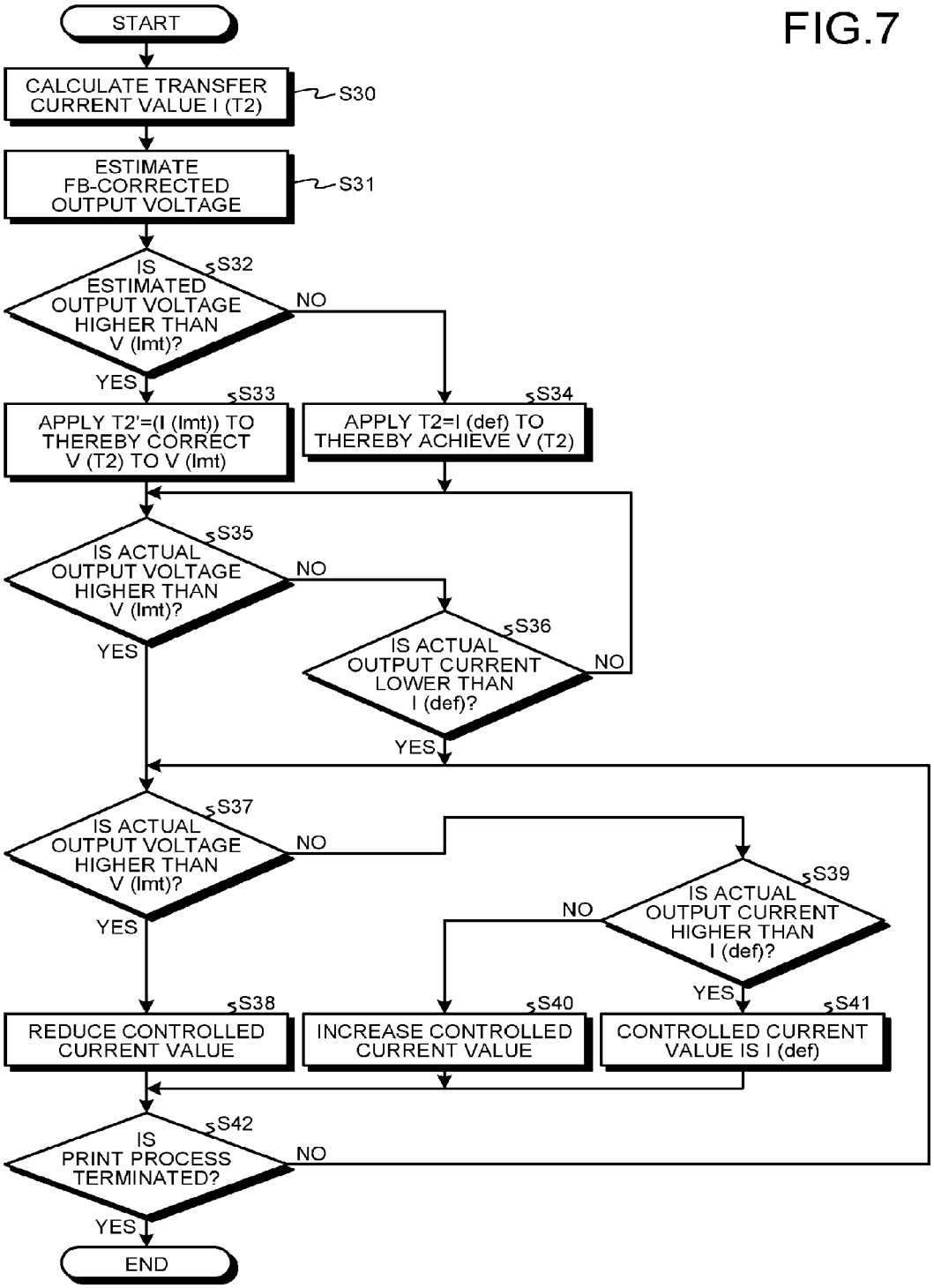
FIG. 7 is a flowchart illustrating a print process according to a first embodiment in the image forming apparatus illustrated in FIG. 1.

The following describes, with reference to a flowchart illustrated in FIG. 7, a print process according to a first embodiment. The print process starts with signaling of a print start by the control unit 50 and covers voltage estimation before paper feeding and correction and application of a current value on the basis of an estimated value. It should be noted that the flowchart is intended as illustrative only to represent an exemplary routine that can achieve effects of the present invention in the first embodiment. Understandably, any other flowchart within the scope of achieving the effects of the present invention may be applied.

When the print process is started, the control unit 50 calculates the transfer current value I (T2) as described above before the paper reaches the primary transfer nip and/or secondary transfer nip (Step S30). The control unit 50 then estimates the output voltage during paper feeding as described above (Step S31). The control unit 50 determines whether the estimated output voltage V (T2) is higher than the limiter voltage V (lmt) (Step S32).

If the estimated output voltage V (T2) is determined to be higher than the limiter voltage V (lmt), the control unit 50 applies the limiter current value T2' (I (lmt)) as a transfer current output to thereby correct the output voltage V (T2) to the limiter voltage V (lmt) (Step S33).

If the estimated output voltage V (T2) is determined not to be higher than the limiter voltage, the control unit 50 applies as the transfer current output a transfer current value T2 (I (def)) that is calculated from the certain conditions including the paper type, paper weight, and the apparatus environment to thereby control to achieve the output voltage V (T2) (Step S34).

The control unit 50 determines whether an actual output voltage is higher than the limiter voltage V (lmt) (Step S35). The actual output voltage refers to the output voltage during paper feeding.

If the actual output voltage is determined to be higher than the limiter voltage V (lmt), the process proceeds to Step S37. If the actual output voltage is determined not to be higher than the limiter voltage V (lmt), the control unit 50 then determines whether an actual output current is lower than a current value I (def) that is calculated from the certain conditions including the paper type, paper weight, and environment (Step S36). The actual output current refers to the output current during paper feeding.

If the actual output current is determined to be lower than the current value I (def) that is calculated from the certain conditions including the paper type, paper weight, and environment, the process proceeds to Step S37. If the actual output current is determined not to be lower than the current value I (def) that is calculated from the certain conditions including the paper type, paper weight, and environment, the process returns to Step S35.

The control unit 50 determines whether the actual output voltage is higher than the limiter voltage V (lmt) (Step S37).

If the actual output voltage is determined to be higher than the limiter voltage V (lmt), the control unit 50 reduces a controlled current value from a present current value to thereby achieve the limiter voltage (Step S38). If the actual output voltage is determined not to be higher than the limiter voltage V (lmt), the control unit 50 determines whether the actual output current is higher than the current value I (def) that is calculated from the certain conditions including the paper type, paper weight, and environment (Step S39).

If the actual output current is determined not to be higher than the current value I (def) that is calculated from the certain conditions including the paper type, paper weight, and environment, the control unit 50 increases the controlled current value from the present current value to thereby achieve the limiter voltage (Step S40). If the actual output current is determined to be higher than the current value I (def) that is calculated from the certain conditions including the paper type, paper weight, and environment, the control unit 50 controls the controlled current value to be the current value I (def) that is calculated from the certain conditions including the paper type, paper weight, and environment (Step S41).

It is determined whether the print process is to be terminated (Step S42). If the print process is not to be terminated, the process returns to Step S37. If the print process is to be terminated, the process is terminated.

The following describes effects achieved by the image forming apparatus according to the present embodiment.

The above-described control provided by the control unit 50 of the image forming apparatus 100 in the present embodiment enables estimation of the voltage output during paper feeding, so that an appropriate transfer current can be obtained. Because the estimated current is relatively small as compared with the current during paper feeding, no likelihood exists that an excessively high voltage will be output to produce an electric discharge during the application of the current for estimation before paper feeding is started. Furthermore, during paper feeding, too, no likelihood exists that an excessively high voltage will be output to produce an electric discharge during the application of a current value that has been corrected as necessary on the basis of the output estimation.

When the control unit 50 estimates that the output voltage exceeds the limiter voltage during times in which paper is not being fed and applies a current having a current value corrected so as to make the output voltage corresponding to the limiter voltage, and if the actual output voltage is lower than the limiter voltage, the control unit 50 controls the current so that the output voltage is a value calculated from the certain conditions. This arrangement can prevent the output voltage from being lower than the limiter voltage.

When the control unit 50 estimates that the output voltage does not exceed the limiter voltage during times in which paper is not being fed and applies a current having a current value corrected so as to make the output voltage corresponding to the voltage calculated from the certain conditions, and if the actual output voltage exceeds the limiter voltage, the control unit 50 controls the current so as to make the output voltage equivalent to the limiter voltage. The current value can therefore be increased to achieve a target voltage output. Moreover, even when the current value is increased, the voltage to be applied does not exceed the limiter voltage, so that an appropriate voltage can be applied.

An apparatus that offers a high linear velocity, such as a production printer, has specifications by which the apparatus receive a current value greater than a current value applied to an apparatus that offers a lower linear velocity. When the control of the present embodiment is applied to such an apparatus that offers a high linear velocity, a small current value for estimation applied before the start of paper feeding unfortunately results in a slow rise time.

In the image forming apparatus according to the present embodiment, a large current is first applied and a current smaller than the first large current is thereafter applied.

The following details the foregoing with reference to actual measured values. It is noted that 90% of a target power source output is referred to as a rise output. Time to reach the rise output is referred to as a rise time.

Figure 8:
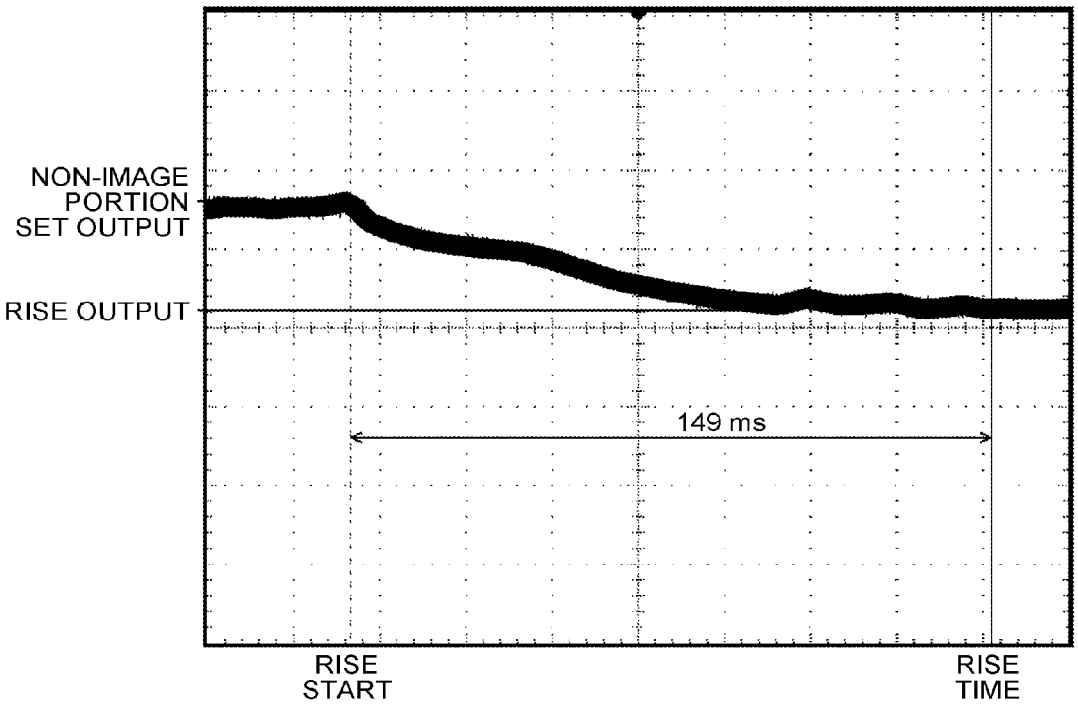
FIG. 8 is a graph illustrating a modification of the image forming apparatus illustrated in FIG. 1.

For example, as illustrated in FIG. 8, the rise time for a target output of −20 μA is 149 ms.

Figure 9:
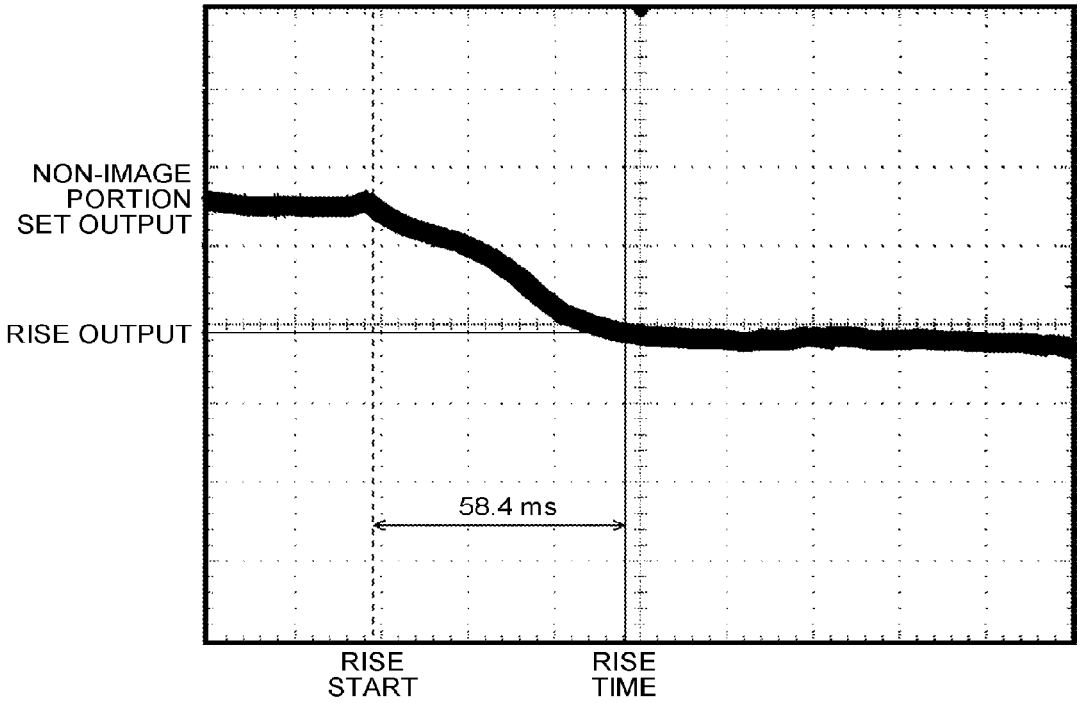
FIG. 9 is a graph illustrating another modification of the image forming apparatus illustrated in FIG. 1.

As illustrated in FIG. 9, the rise time for a target output of −40 μA is 58.4 ms.

The foregoing relation reveals that the higher the target output, the shorter the rise time. As a result, the rise time can be shortened by first applying the greater current value out of the set current values for estimation during the application of the current for estimation before the start of paper feeding and thereafter applying the smaller current value. In addition, a steady output can be obtained, so that a highly accurate estimation can be made with a current that is small enough to eliminate the likelihood of an electric discharge and other faulty symptoms. The estimation is made using a current value smaller than during paper feeding during the application of the current for estimation before the start of paper feeding. The first application of the current value that is, out of the current values for estimation, closer to the current value used during paper feeding allows the rise time and time to reach a steady output to be shortened.

To change target outputs, the applied current is switched from a first larger current to a second current that is smaller than the first current.

Figure 10:
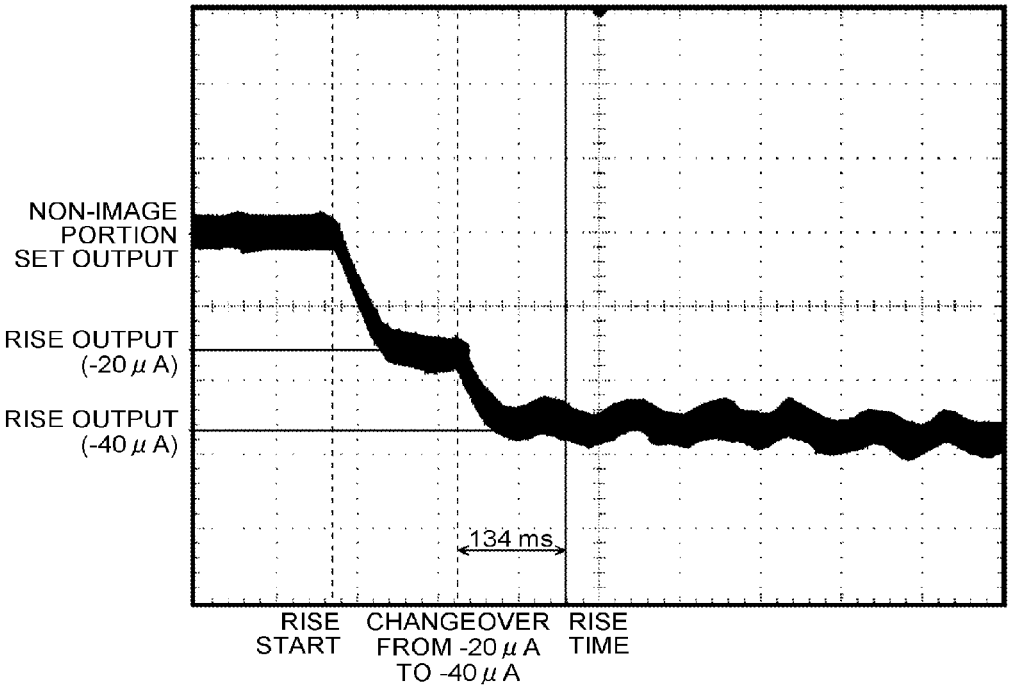
FIG. 10 is a graph illustrating still another modification of the image forming apparatus illustrated in FIG. 1.

Reference is made, for example, to FIG. 10 in which the target output is first set to −20 μA and the target output is thereafter changed from −20 μA to −40 μA. FIG. 10 depicts that the rise time as counted from the changeover from −20 μA to −40 μA is 134 ms.

Figure 11:
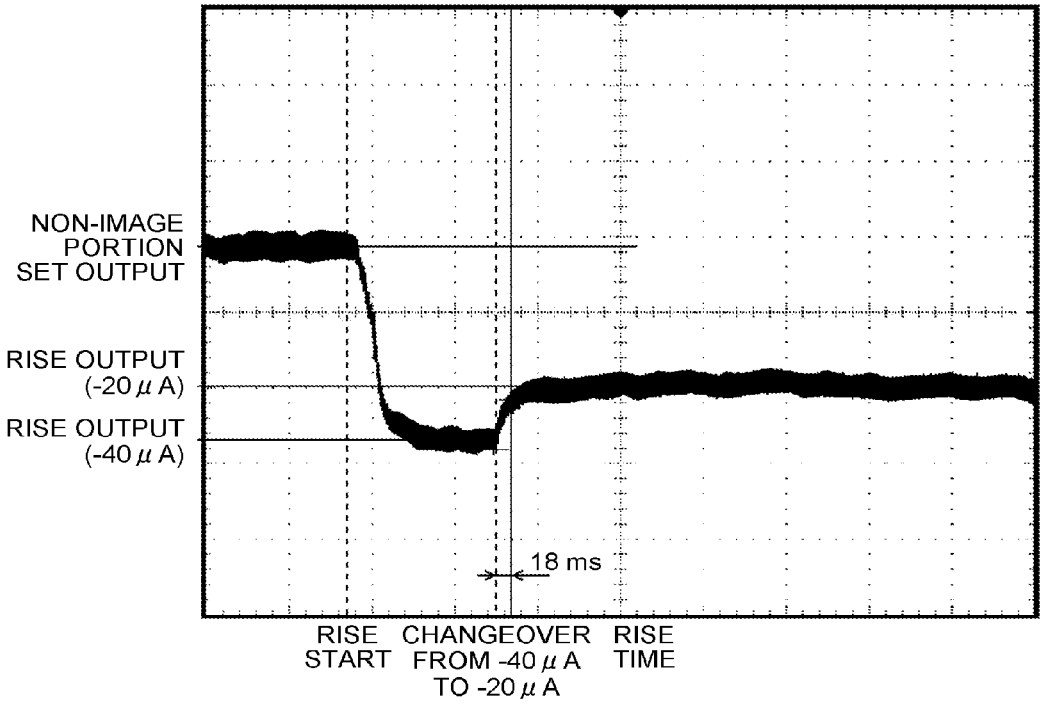
FIG. 11 is a graph illustrating a further modification of the image forming apparatus illustrated in FIG. 1.

Meanwhile, as illustrated in FIG. 11 in which the target output is first set to −40 μA and the target output is thereafter changed from −40 μA to −20 μA. FIG. 11 depicts that the rise time as counted from the changeover from −40 μA to −20 μA is 18 ms.

The foregoing relation reveals that the rise time is shorter when the target output is changed from a higher value to a lower value. Thus, an even higher accuracy can be achieved in the estimation.

Figure 12:
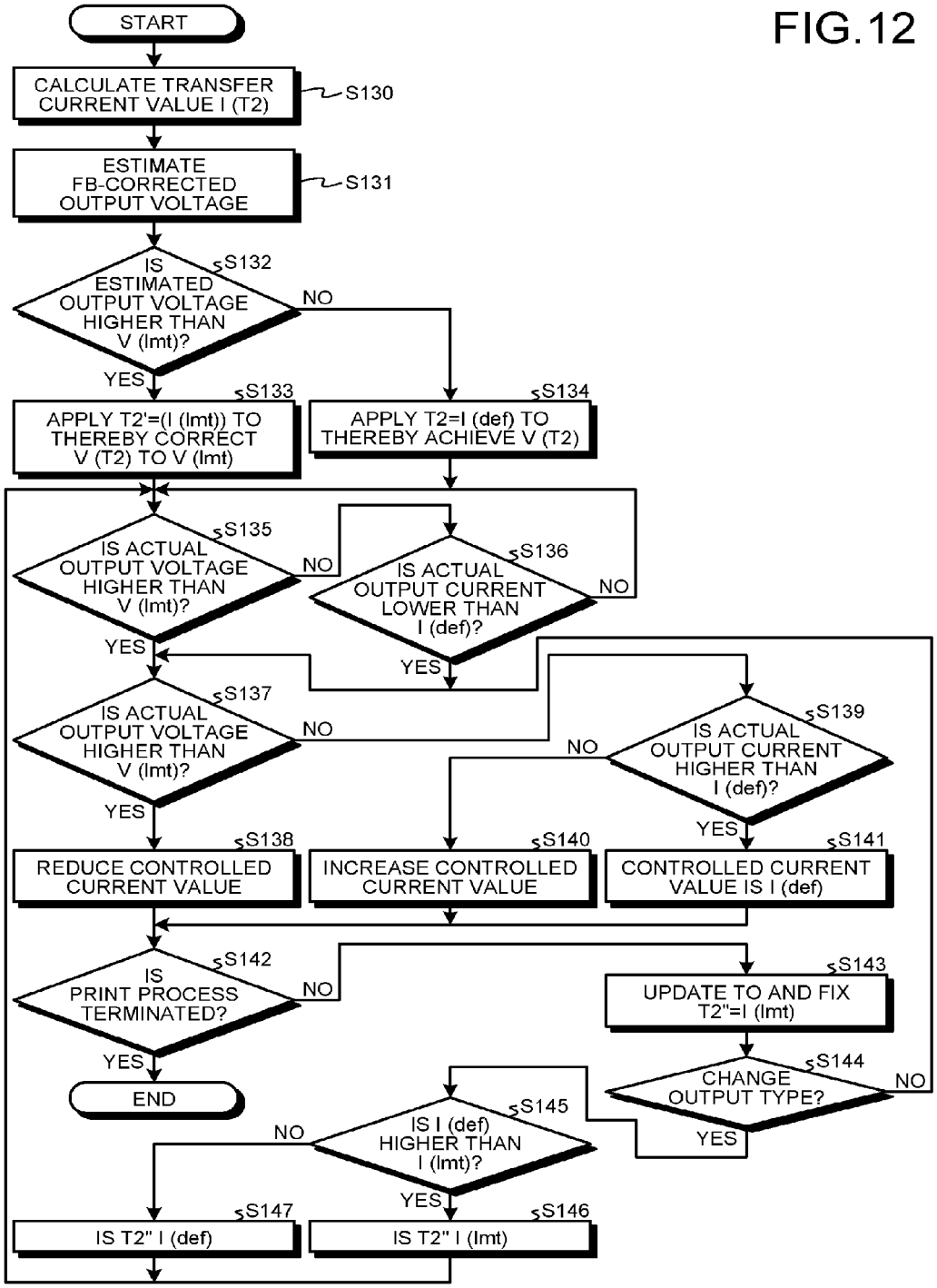
FIG. 12 is a flowchart illustrating a print process according to a second embodiment.

The following describes, with reference to a flowchart illustrated in FIG. 12, a print process according to a second embodiment. The print process starts with signaling of a print start by the control unit 50 and covers voltage estimation before paper feeding and correction and application of a current value on the basis of an estimated value.

When the print process is started, the control unit 50 calculates the transfer current value I (T2) as described above before the paper reaches the primary transfer nip and/or secondary transfer nip (Step S130). The control unit 50 then estimates the output voltage during paper feeding as described above (Step S131). The control unit 50 determines whether the estimated output voltage V (T2) is higher than the limiter voltage V (lmt) (Step S132).

If the estimated output voltage V (T2) is determined to be higher than the limiter voltage V (lmt), the control unit 50 applies the limiter current value T2' (I (lmt)) as the transfer current output to thereby correct the output voltage V (T2) to the limiter voltage V (lmt) (Step S133).

If the estimated output voltage V (T2) is determined not to be higher than the limiter voltage, the control unit 50 applies as the transfer current output a transfer current value T2 (I (def)) that is calculated from the certain conditions including the paper type, paper weight, and the apparatus environment to thereby control to achieve the output voltage V (T2) (Step S134).

The control unit 50 determines whether an actual output voltage is higher than the limiter voltage V (lmt) (Step S135). The actual output voltage refers to the output voltage during paper feeding.

If the actual output voltage is determined to be higher than the limiter voltage V (lmt), the process proceeds to Step S137. If the actual output voltage is determined not to be higher than the limiter voltage V (lmt), the control unit 50 then determines whether an actual output current is lower than a current value I (def) that is calculated from the certain conditions including the paper type, paper weight, and environment (Step S136). The actual output current refers to the output current during paper feeding.

If the actual output current is determined to be lower than the current value I (def) that is calculated from the certain conditions including the paper type, paper weight, and environment, the process proceeds to Step S137. If the actual output current is determined not to be lower than the current value I (def) that is calculated from the certain conditions including the paper type, paper weight, and environment, the process returns to Step S135.

The control unit 50 determines whether the actual output voltage is higher than the limiter voltage V (lmt) (Step S137).

If the actual output voltage is determined to be higher than the limiter voltage V (lmt), the control unit 50 reduces a controlled current value from a present current value to thereby achieve the limiter voltage (Step S138). If the actual output voltage is determined not to be higher than the limiter voltage V (lmt), the control unit 50 determines whether the actual output current is higher than the current value I (def) that is calculated from the certain conditions including the paper type, paper weight, and environment (Step S139).

If the actual output current is determined not to be higher than the current value I (def) that is calculated from the certain conditions including the paper type, paper weight, and environment, the control unit 50 increases the controlled current value from the present current value to thereby achieve the limiter voltage (Step S140). If the actual output current is determined to be higher than the current value I (def) that is calculated from the certain conditions including the paper type, paper weight, and environment, the control unit 50 controls the controlled current value to be the current value I (def) that is calculated from the certain conditions including the paper type, paper weight, and environment (Step S141).

It is determined whether the print process is to be terminated (Step S142).

If the print process is to be terminated, the process is terminated. If the print process is not to be terminated, a controlled current value T2" corrected at Step S138, Step S140, and Step S141 is set to update the limiter current value I (lmt) (Step S143).

The control unit 50 then determines whether a transfer condition (output type) is to be changed (Step S144).

If the output condition is not to be changed, the process returns to Step S137. If the output condition is to be changed, the process proceeds to Step S145.

At Step S145, the control unit 50 determines whether the current value I (def) that is calculated from the certain conditions including the paper type, paper weight, and environment is greater than the limiter current value I (lmt) (Step S145).

If the current value I (def) that is calculated from the certain conditions including the paper type, paper weight, and environment is determined to be greater than the limiter current value I (lmt), the control unit 50 applies a limiter current value T2" (I (lmt)) as the transfer current output (Step S146) and returns the process to Step S135. If the current value I (def) that is calculated from the certain conditions including the paper type, paper weight, and environment is determined not to be greater than the limiter current value I (lmt), the control unit 50 applies a limiter current value T2" (I (def)) as the transfer current output (Step S147) and returns the process to Step S135.

Through the foregoing arrangements, even when a voltage exceeding the limiter voltage is applied during a print job due to an error contained in the estimated value before the start of paper feeding, the limiter current value I (lmt) that corresponds to the limiter voltage is corrected and updated, so that an appropriate current value can be obtained. Additionally, even when the apparatus undergoes a change in its conditions including its interior temperature during a print job that involves a large number of sheets of paper being fed therethrough, the limiter current value I (lmt) that corresponds to the limiter voltage is updated, so that an appropriate current value according to the condition can be obtained.

The following describes the output voltages when the control of the first and second embodiments described above is performed and the output voltage when the control is not performed.

Figure 13:
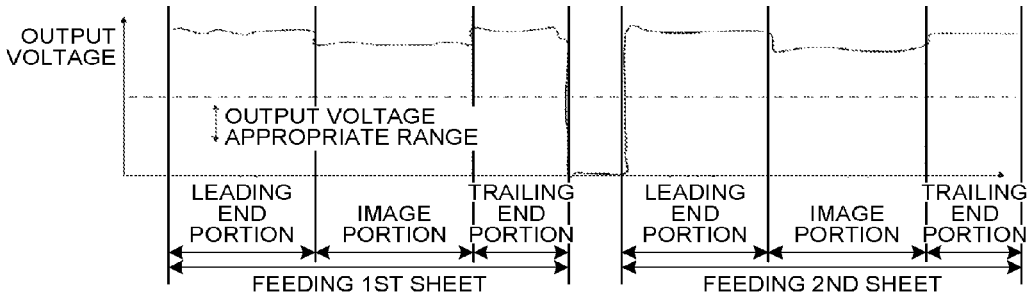
FIG. 13 is a graph illustrating an output voltage in a conventional print process.
Figure 14:
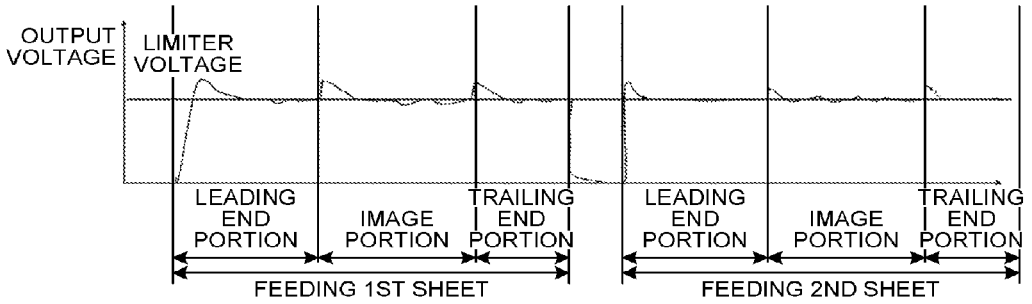
FIG. 14 is a graph illustrating the output voltage when a print process according to the first embodiment is performed.
Figure 15:
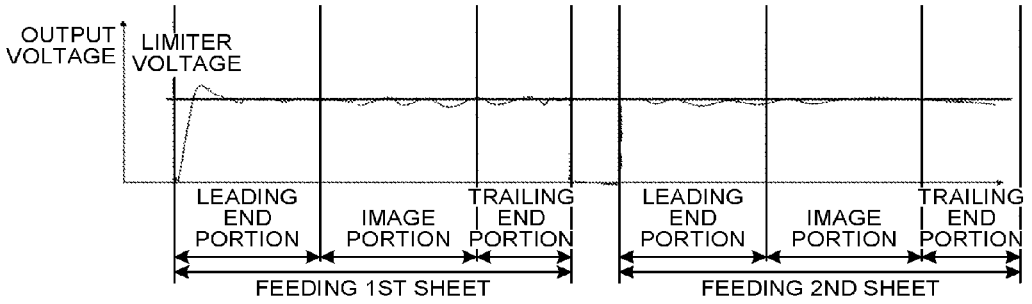
FIG. 15 is a graph illustrating the output voltage when a print process according to the second embodiment is performed.

FIG. 14 is a graph illustrating the output voltage when the control of the first embodiment is performed. FIG. 15 is a graph illustrating the output voltage when the control of the second embodiment is performed. FIG. 13 is a graph illustrating the output voltage when neither the control of the first embodiment nor the control of the second embodiment is performed.

When neither the control of the first embodiment nor the control of the second embodiment is performed, the control is performed with a constant current with a resistance value increased due to deterioration over time, environmental fluctuations, and other factors. Thus, as illustrated in FIG. 13, an excessive output that exceeds the output voltage appropriate range can occur, resulting in an electric discharge or other fault. As a result, not only a faulty image, but also a machine failure may occur.

In contrast, when the control of the first embodiment is performed with the resistance value increased due to deterioration over time, environmental fluctuations, and other factors, an initial output voltage is determined to be high on the basis of the estimation made before paper feeding and the output voltage is corrected accordingly. This control eliminates the likelihood that an excessive output that exceeds the output voltage appropriate range will occur as illustrated in FIG. 14. Furthermore, when the output is to be changed within one sheet of paper being fed through the apparatus, for example, at a leading end, in an image portion, and at a trailing end portion, the output voltage may be similarly corrected on the basis of the estimated value taken before paper feeding at the change of the output type. This approach can keep the output equal to or less than a certain limiter voltage.

The control according to the first embodiment can, however, entail errors in the output due to variations in the estimation and changes in conditions of the apparatus. Such an error can occur each time the output type is changed. Thus, each change of the output type may cause, for example, a faulty image to occur even with the excessive output being prevented.

With the control in the second embodiment, if control is activated to adjust the output voltage to the limiter voltage following the estimation before paper feeding, the correction value (corrected controlled current value) immediately before the change of the output type is stored and updated. Thus, no error occurs at each change of the output type as illustrated in FIG. 15. The error in the output can thus be minimized. Additionally, even when the condition, such as the apparatus interior temperature, changes, updating the limiter current allows an optimum value to be obtained for each of different conditions.

It is noted that, in the control according to the second embodiment, the comparison between the output voltage and the limiter voltage V (lmt) at Step S137 of FIG. 12 is made at short intervals, for example, every 20 ms. The correction of the controlled current value is also performed at identical intervals (20 ms). The correction of the controlled current value is performed on a real-time basis on a sheet of paper being conveyed onto the transfer nip at a high linear velocity as the linear velocity offered by, for example, the production printer.

In the control according to the second embodiment, the correction value (corrected controlled current value) is stored and updated on a real-time basis and the correction value (corrected controlled current value) immediately before the change of the output type (a timing of 20 ms or less before a timing at which the output type is changed) is stored and updated. The error can thereby be minimized.

While the present invention has been described with reference to specific embodiments, it will be understood that the embodiments are not intended to limit the present invention. For example, the control according to the above-described embodiments, although having been described to be directed to the secondary transfer unit, may still be applied to the primary transfer unit. It should be noted that materials and dimensions of each of the elements described in the above embodiments are illustrative only and various other types of materials and dimensions may be selected within the scope in which the effects of the present invention can be achieved.

According to the embodiments, it is possible to provide an image forming apparatus that does not develop over time a fault during application of a current.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus, comprising:

a transfer unit that transfers a toner image on an image bearer onto a transfer medium; and a controller that controls a transfer voltage to be output to the transfer unit in accordance with a certain condition, wherein the controller:

applies currents having at least two different values during times in which paper is not being fed, the two current values being lower than a current value during paper feeding;

estimates an output voltage on a basis of a voltage detected through the application of the currents;

controls, when the estimated output voltage falls below a certain limiter voltage, to bring the output voltage to a value calculated through the certain condition; and controls, when the estimated output voltage exceeds the certain limiter voltage, to bring the output voltage to the limiter voltage, wherein the certain condition includes at least one of a linear velocity, a temperature or a humidity, a size of the transfer medium, a type of the transfer medium, a thickness of the transfer medium, resistance of a transfer portion that transfers the toner image from the image bearer to the transfer medium, and a position on the transfer medium in a transfer medium conveyance direction.

2. The image forming apparatus according to claim 1, wherein the controller first applies, of the currents having at least the two different values, a current having a greater value.

3. The image forming apparatus according to claim 1, wherein the controller controls the current to control the output voltage.

4. The image forming apparatus according to claim 3, wherein the controller, when having corrected to bring the output voltage that is higher than the limiter voltage during paper feeding to the limiter voltage, updates an output current that corresponds to the corrected output voltage as a limiter current until the certain condition changes.

5. An image forming apparatus, comprising:

a transfer unit that transfers a toner image on an image bearer onto a transfer medium; and a controller that controls a transfer voltage to be output to the transfer unit in accordance with a certain condition, wherein the controller:

applies currents having at least two different values during times in which paper is not being fed, the two current values being lower than a current value during paper feeding;

estimates an output voltage on a basis of a voltage detected through the application of the currents;

controls, when the estimated output voltage falls below a certain limiter voltage, to bring the output voltage to a value calculated through the certain condition; and controls, when the estimated output voltage exceeds the certain limiter voltage, to bring the output voltage to the limiter voltage, wherein when the output voltage during paper feeding is lower than the limiter voltage, the controller corrects to bring the output voltage to the value calculated through the certain condition.

6. An image forming apparatus, comprising:

a transfer unit that transfers a toner image on an image bearer onto a transfer medium; and a controller that controls a transfer voltage to be output to the transfer unit in accordance with a certain condition, wherein the controller:

applies currents having at least two different values during times in which paper is not being fed, the two current values being lower than a current value during paper feeding;

estimates an output voltage on a basis of a voltage detected through the application of the currents;

controls, when the estimated output voltage falls below a certain limiter voltage, to bring the output voltage to a value calculated through the certain condition; and controls, when the estimated output voltage exceeds the certain limiter voltage, to bring the output voltage to the limiter voltage, wherein when the output voltage during paper feeding is higher than the limiter voltage, the controller corrects to bring the output voltage to the limiter voltage.

* * * * *